US008444426B1

(12) United States Patent
Yang

(10) Patent No.: US 8,444,426 B1
(45) Date of Patent: May 21, 2013

(54) LAMP HOLDER CONNECTOR

(75) Inventor: Mei-Chuan Yang, Taoyuan Country (TW)

(73) Assignee: Proconn Technology Co., Ltd., Taoyuan Country (TW)

( * ) Notice: Subject to any disclaimer, the term of this patent is extended or adjusted under 35 U.S.C. 154(b) by 28 days.

(21) Appl. No.: 13/345,068

(22) Filed: Jan. 6, 2012

(51) Int. Cl.
*H01R 33/08* (2006.01)

(52) U.S. Cl.
USPC ..... 439/227; 313/318.02; 362/216

(58) Field of Classification Search
USPC ..... 439/226, 229, 232–239; 313/318.01, 313/318.02, 318.05; 262/216, 225, 227, 260
See application file for complete search history.

(56) References Cited

U.S. PATENT DOCUMENTS 2,349,255 A * 5/1944 Epstein ..... 362/216
4,347,460 A * 8/1982 Latassa et al. ..... 315/63
4,643,503 A * 2/1987 Johnson et al. ..... 439/227
6,083,021 A * 7/2000 Lau ..... 439/227
6,741,018 B2 * 5/2004 Bankuti et al. ..... 313/318.01

* cited by examiner

*Primary Examiner* — Khiem Nguyen
(74) *Attorney, Agent, or Firm* — WPAT, P.C.; Anthony King

(57) ABSTRACT

A lamp holder connector includes a lamp box and at least one pair of lamp bases assembled to the lamp box. The lamp box includes a first upper holder, at least one pair of first lower holders assembled to the first upper holder, and at least one pair of first terminals received in the lamp box. Each side of the first upper holder defines an elastic portion. An outer face of each elastic portion defines at least one fastening portion. Each lamp base includes a second upper holder assembled to the first lower holder, a second lower holder assembled to the second upper holder, and a second terminal received in the second lower holder. At least one side of the second upper holder defines a receiving groove for receiving the elastic portion. A sidewall of the receiving groove defines at least one fastening hole for buckling the fastening portion.

10 Claims, 5 Drawing Sheets

LAMP HOLDER CONNECTOR

BACKGROUND OF THE INVENTION

1. Field of the Invention

The present invention generally relates to a lamp holder connector, and more particularly to a lamp holder connector capable of disassembling a lamp therefrom swiftly.

2. The Related Art

A conventional lamp holder connector adapted for connecting with a U-shaped lamp includes a lamp box, a pair of lamp bases, a pair of first terminals received in the lamp box, and a pair of second terminals received in the lamp bases. Two ends of the U-shaped lamp are assembled to the lamp box to contact with the two first terminals. The two lamp bases with the second terminals received therein are assembled upward to the lamp box with the first terminals therein to make the first terminals electrically connect with the second terminals. However, when the U-shaped lamp has a breakdown or a brightness attenuation, it's difficult for the U-shaped lamp to be disassembled from the lamp holder connector that makes the U-shaped lamp be replaced inconveniently.

SUMMARY OF THE INVENTION

An object of the present invention is to provide a lamp holder connector adapted for connecting with a U-shaped lamp. The lamp holder connector includes a lamp box and at least one pair of lamp bases assembled upward to the lamp box. The lamp box includes a first upper holder, at least one pair of first lower holders and at least one pair of first terminals. The first upper holder has a top wall. Two opposite sides of the top wall bend downward to form two first side walls. A bottom of each first side wall extends downward, and then is curved upward to form an elastic portion with a free end thereof facing to an outer surface of the corresponding first side wall. An outer face of each elastic portion defines at least one fastening portion. The first lower holders are assembled upward to the first upper holder to define receiving spaces between the first upper holder and the first lower holders for receiving two ends of the U-shaped lamp. The first terminals are assembled in the receiving spaces respectively with tops thereof contacting with the two ends of the U-shaped lamp and bottoms thereof passing downward through the corresponding first lower holders. Each of the lamp bases includes a second upper holder, a second lower holder and a second terminal. The second upper holder has a first base wall. Two opposite sides of the first base wall extend upward to form two first lateral walls. A portion of at least one first lateral wall is concaved outward to form a receiving groove. A sidewall of the receiving groove opposite to the other first lateral wall defines at least one fastening hole. The second upper holder is assembled upward to the first lower holder with the elastic portion received in the receiving groove and the fastening portion buckled in the fastening hole. The bottom of the first terminal passes downward through the second upper holder. The second lower holder is assembled upward to the second upper holder. The second terminal is received in the second lower holder to electrically connect with the bottom of the first terminal.

As described above, the lamp box of the lamp holder connector is fastened to the lamp base of the lamp holder connector tightly by means of receiving the elastic portions in the receiving grooves and buckling the fastening portions in the fastening holes. The U-shaped lamp is disassembled from the lamp box swiftly by means of pushing the elastic portions to move inward so as to bring along the fastening portions to move inward until the fastening portions are apart away from the fastening holes completely. As a result, the U-shaped lamp can be changed conveniently.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
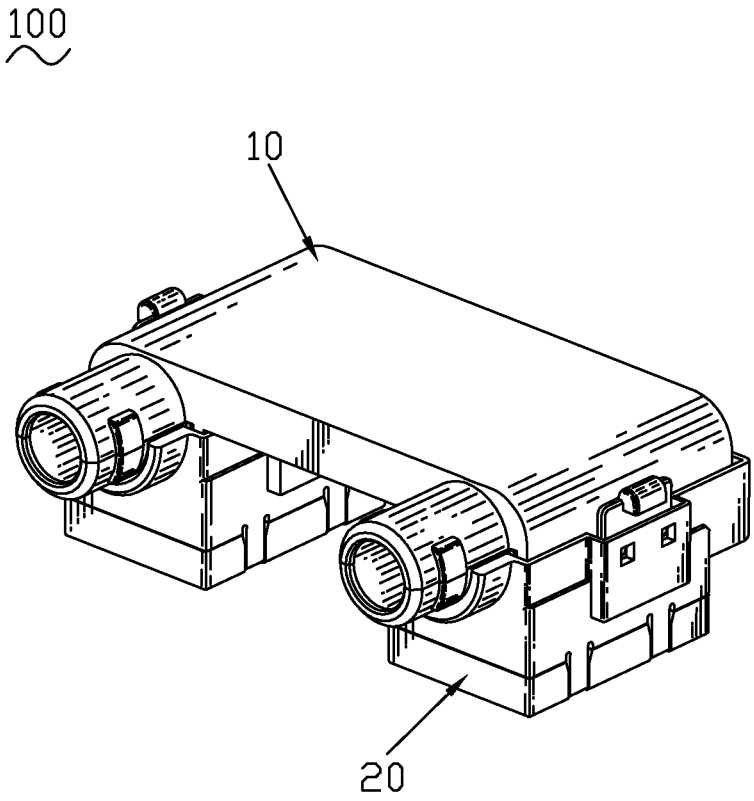
FIG. 1 is a perspective view of a lamp holder connector in accordance with the present invention.
Figure 6:
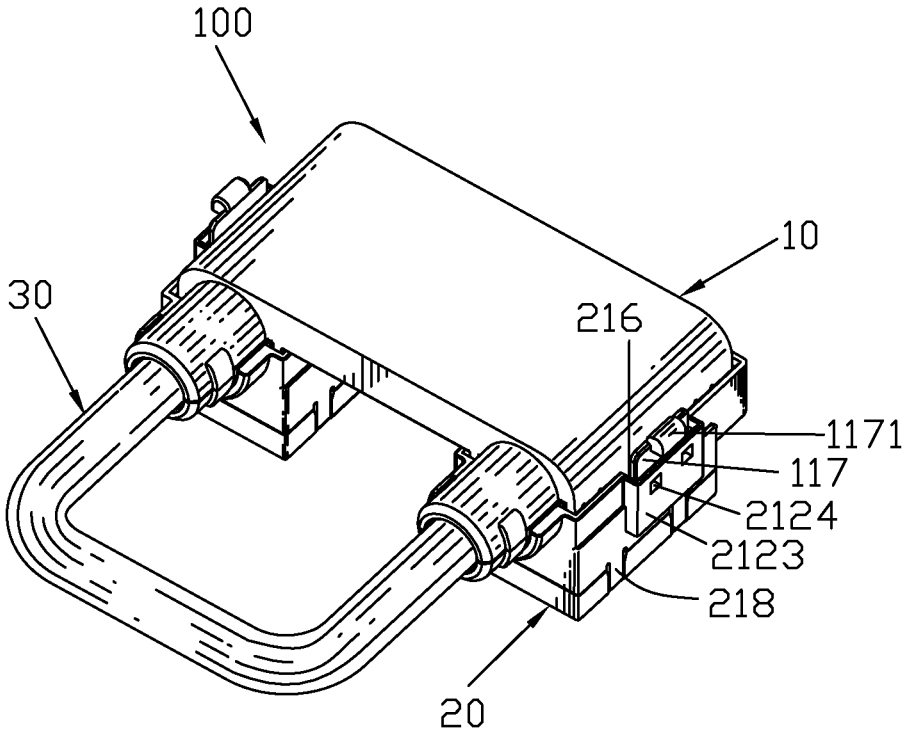
FIG. 6 is an assembling view showing that a U-shaped lamp is connected with the lamp holder connector of FIG. 1.

With reference to FIG. 1 and FIG. 6, a lamp holder connector 100 in accordance with the present invention is shown. The lamp holder connector 100 adapted for connecting with a U-shaped lamp 30 includes a lamp box 10 and a pair of lamp bases 20.

Figure 2:
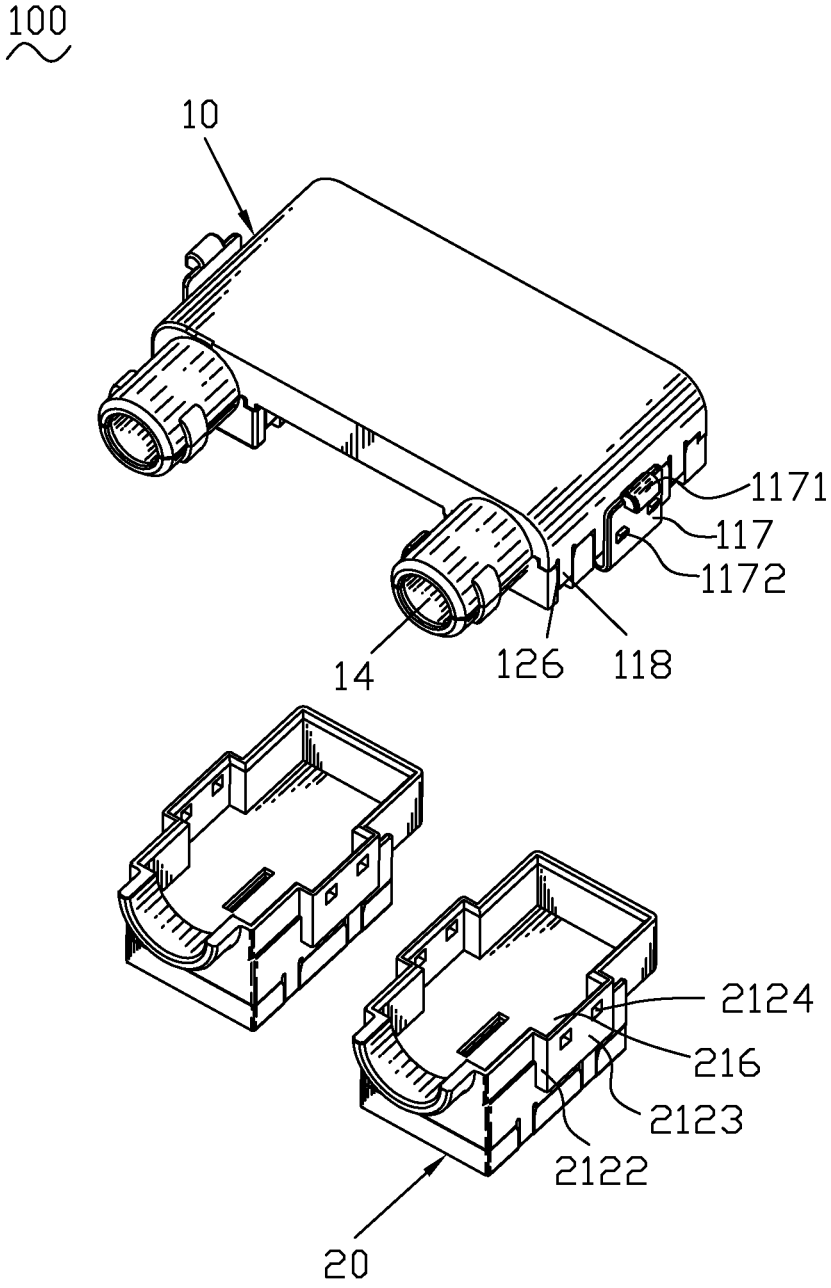
FIG. 2 is a partially exploded view of the lamp holder connector of FIG. 1.
Figure 3:
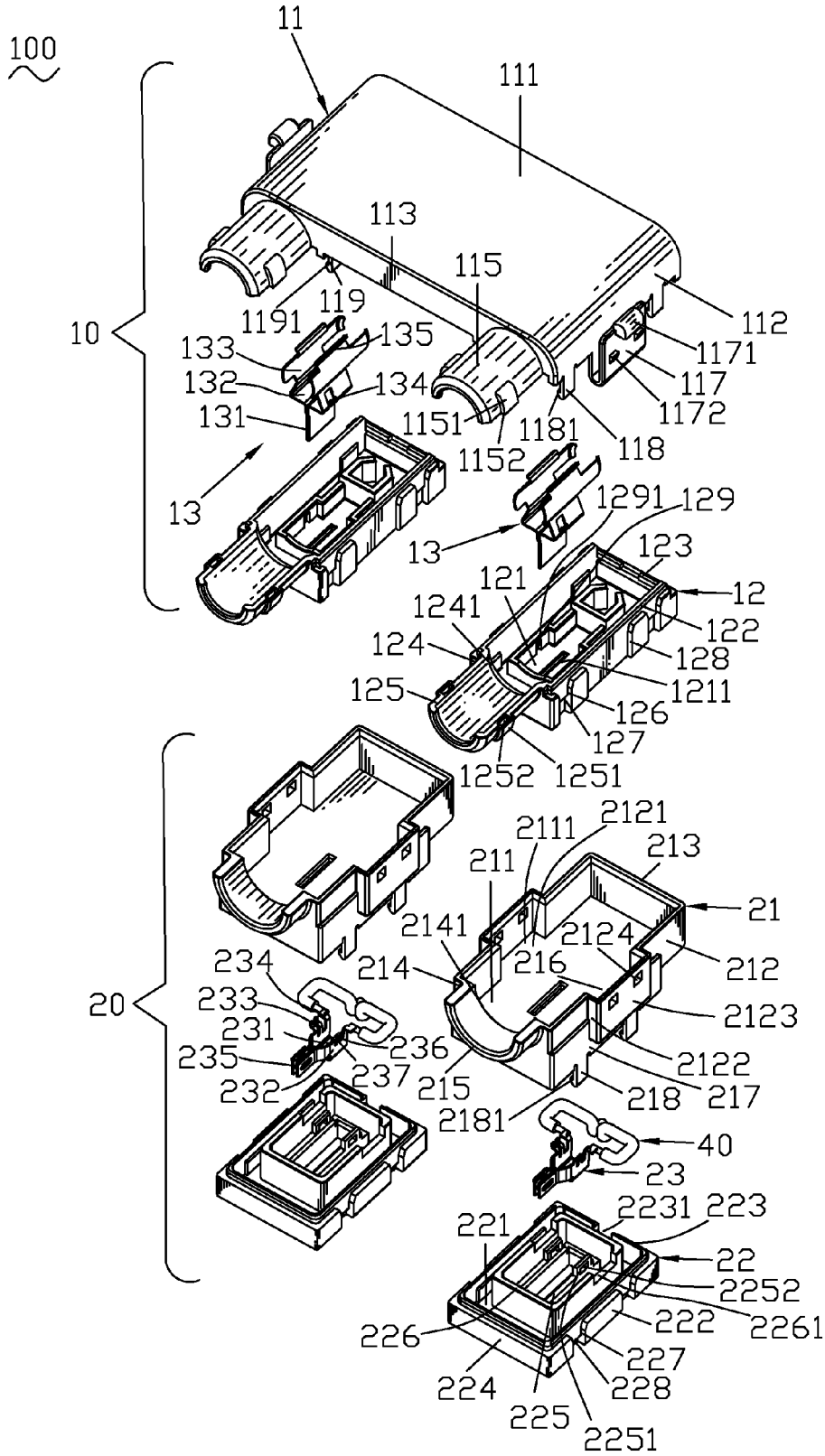
FIG. 3 is an exploded view of the lamp holder connector of FIG. 1.
Figure 4:
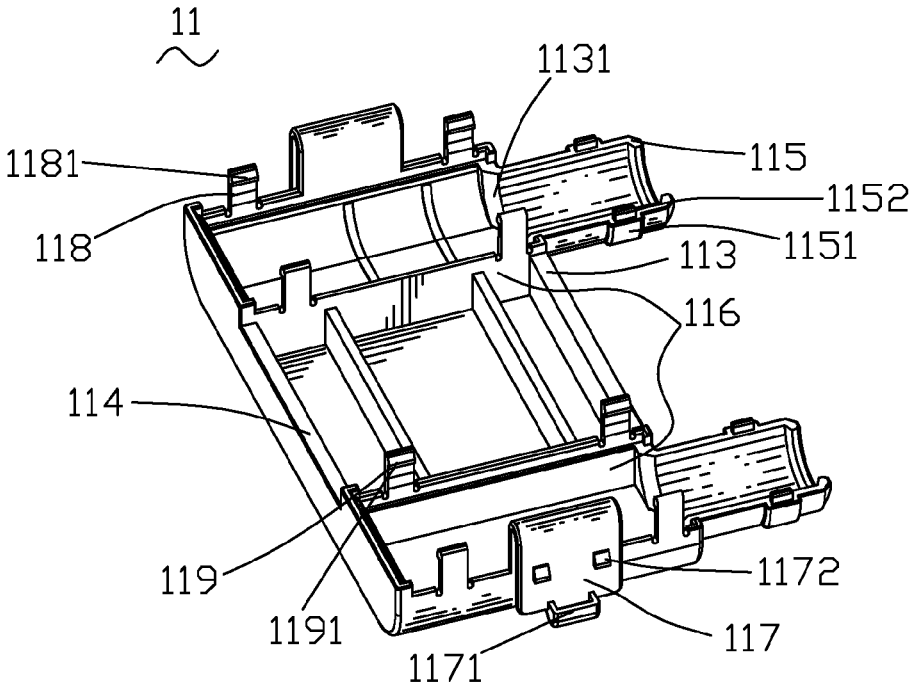
FIG. 4 is a perspective view of a first upper holder of the lamp holder connector of FIG. 3.

Referring to FIG. 2, FIG. 3 and FIG. 4, the lamp box 10 includes a first upper holder 11, a pair of first lower holders 12 and a pair of first terminals 13. The first upper holder 11 has a rectangular top wall 111, two first side walls 112 bent downward from two opposite sides of the top wall 111, a first front wall 113 connecting with front edges of the top wall 111 and the two first side walls 112, and a first rear wall 114 connecting with rear edges of the top wall 111 and the two first side walls 112. Two opposite ends of a bottom of the first front wall 113 are recessed upward to form two arc-shaped first grooves 1131. A periphery of each first groove 1131 extends forward to form a hemi-tube-shaped first propping wall 115. Two opposite sides of an outer surface of the first propping wall 115 define two first convex portions 1151 with two insertion portions 1152 protruding downward from two middles of two bottoms of the two first convex portions 1151. Two connecting walls 116 are extended downward from two sides of a bottom of the top wall 111 and located between the two first grooves 1131. The two connecting walls 116 are connected with inner surfaces of the first front wall 113 and the first rear wall 114 and far away from each other.

Referring to FIG. 3 and FIG. 4, a middle of a bottom of each first side wall 112 extends downward, and then is curved upward to form an elastic portion 117 with a free end thereof facing to an outer surface of the corresponding first side wall 112. A middle of a top of the free end of the elastic portion 117 protrudes outward to form a pressing portion 1171. Two portions of an outer face of the elastic portion 117 protrude outward to form two fastening portions 1172. Two ends of the bottom of the first side wall 112 protrude downward to form two first buckling portions 118. Two ends of a bottom of each connecting wall 116 protrude downward to form two second buckling portions 119 opposite to the first buckling portions 118 respectively. Two bottoms of two facing surfaces of the first buckling portion 118 and the second buckling portion 119 protrude face to face to form a first barb 1181 and a second barb 1191, respectively.

Referring to FIG. 2 and FIG. 3, the first lower holder 12 has a rectangular bottom wall 121, two second side walls 122 extending upward from two opposite sides of the bottom wall 121, a second rear wall 123 connecting with rear ends of the two second side walls 122 and a second front wall 124 connecting with front ends of the two second side walls 122. A top of the second front wall 124 is concaved downward to form an arc-shaped second groove 1241. A periphery of the second groove 1241 extends forward to form a hemi-tube-shaped second propping wall 125 matching with the first propping wall 115. Two opposite ends of an outer surface of each second side wall 122 are recessed inward to form two first buckling grooves 126. A bottom of an inner wall of each first buckling groove 126 is further recessed inward to form a first blocking groove 127. A middle of the outer surface of the second side wall 122 is recessed inward to form a fastening groove 128. Two opposite sides of an outer surface of the second propping wall 125 define two second convex portions 1251 with two insertion grooves 1252 being opened in two middles of two tops of the two second convex portions 1251. A frame 129 is located on a top of the bottom wall 121. An inner surface of each side of the frame 129 defines a fixing groove 1291. The bottom wall 121 defines an insertion slot 1211 vertically penetrating therethrough and located between the two sides of the frame 129.

Referring to FIG. 3, the first terminal 13 has an insertion piece 131 folded up by a piece of metal. Two free ends of the insertion piece 131 are extended oppositely to form two connecting pieces 132. Two free ends of the two connecting pieces 132 are inclined towards each other, and then arced oppositely to form two clamping pieces 133. Two lower portions of the two clamping pieces 133 are punched outward to form two fixing pieces 134. Two middles of two free ends of the two clamping pieces 133 are arced face to face to form two guiding pieces 135.

Referring to FIG. 2, FIG. 3 and FIG. 4, when the lamp box 10 is in assembly, the first terminal 13 is assembled downward in the first lower holder 12 with the insertion piece 131 being inserted into the insertion slot 1211, the connecting pieces 132 being located in the frame 129, upper portions of the clamping pieces 133 and the guiding pieces 135 projecting beyond the frame 129, the lower portions of the clamping pieces 133 located in the frame 129, and the fixing pieces 134 being fixed in the fixing grooves 1291. Then the first upper holder 11 is covered downward on the first lower holders 12. The two second side walls 122 of each first lower holder 12 are corresponding to the first side wall 112 and the connecting wall 116, and the second rear wall 123 and the second propping wall 125 of each first lower holder 12 are corresponding to one end of the first rear wall 114 and the first propping wall 115 so as to surround a receiving space 14 thereamong. The first buckling portions 118 and the second buckling portions 119 are buckled in the first buckling grooves 126 with the first barbs 1181 and the second barbs 1191 hooking top inner end walls of the first blocking grooves 127. The elastic portions 117 are fastened in the fastening grooves 128. The insertion portions 1152 are inserted into the insertion grooves 1252. So the first upper holder 11 is assembled with the two first lower holders 12 tightly.

Figure 5:
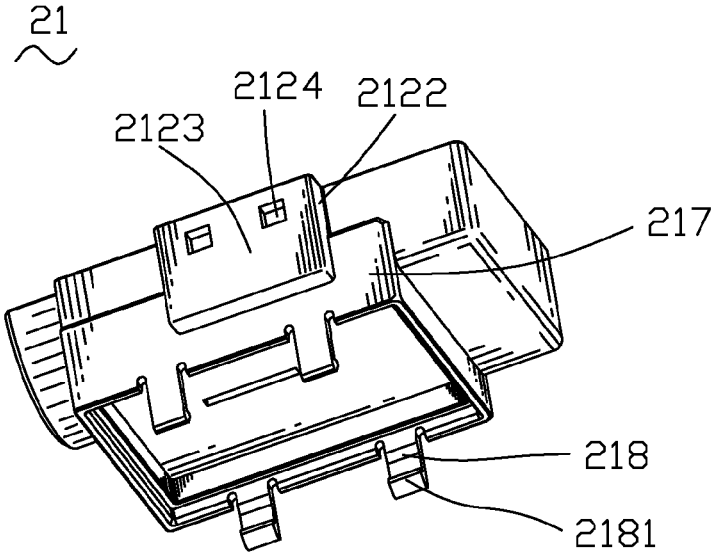
FIG. 5 is a perspective view of a second upper holder of the lamp holder connector of FIG. 3.

Referring to FIG. 2, FIG. 3 and FIG. 5, each of the lamp bases 20 includes a second upper holder 21, a second lower holder 22 and a second terminal 23. The second upper holder 21 has a rectangular first base wall 211, two first lateral walls 212 extending upward from two opposite sides of the first base wall 211, and a first rear end wall 213 and a first front end wall 214 extending upward from a rear end and a front end of the first base wall 211 respectively. A top of the first front end wall 214 is concaved downward to form an arc-shaped third groove 2141. A periphery of the third groove 2141 extends forward to form a semi-tube-shaped supporting wall 215. A middle of each first lateral wall 212 is cut off to define a gap 2121. Two middles of the two opposite sides of the first base wall 211 extend oppositely to form two base extending walls 2111 passing through the gaps 2121. Two opposite sidewalls of each gap 2121 extend outward to form two lateral extending walls 2122. A blocking wall 2123 connects with the two lateral extending walls 2122 and the base extending wall 2111 to surround a receiving groove 216 thereamong. The blocking wall 2123 defines two fastening holes 2124. A locating frame 217 connects with a front of a bottom of the first base wall 211. Two ends of each side of the locating frame 217 protrude downward to form two third buckling portions 218. An inner side of a bottom of each third buckling portion 218 protrudes inward to form a third barb 2181.

Referring to FIG. 3, the second lower holder 22 has a rectangular second base wall 221, two second lateral walls 222 extending upward from two opposite sides of the second base wall 221, a second rear end wall 223 and a second front end wall 224 extending upward from a rear end and a front end of the second base wall 221. The second rear end wall 223 defines an opening 2231. A fastening frame 225 is located in a top of the second base wall 221. Two ears 2251 are extended upward from two tops of two opposite sides of the fastening frame 225 with two perforations 2252 being formed therein. A supporting frame 226 is located on the top of the second base wall 221 and surrounds the fastening frame 225. Two opposite sides of the supporting frame 226 defines two recesses 2261. Two portions of an outer surface of each second lateral wall 222 are recessed inward to form two second buckling grooves 227. A bottom of an inner wall of each second buckling groove 227 is further recessed inward to form a second blocking groove 228.

Referring to FIG. 3, the second terminal 23 has a base portion 231. Two opposite sides of the base portion 231 are bent upward to form two bending portions 232. Two portions of a top of each bending portion 232 are concaved downward to form two notches 236 with a plurality of connecting portions 237 being defined at intervals. A connecting portion 237 located at a rear of the second terminal 23 is bent outward to form a soldering portion 234. Two connecting portions 237 located at a front of the second terminal 23 are bent outward, and then extend upward to form two locating portions 233. Two middles of two front sides of the two bending portions 232 are inclined towards each other, and then extend forward to form two clipping portions 235.

Referring to FIG. 2, FIG. 3 and FIG. 5, when the lamp base 20 is assembled, the second terminal 23 is assembled downward to the second lower holder 22. The base portion 231, the bending portions 232, the connecting portions 237 and the clipping portions 235 are located in the fastening frame 225. The locating portions 233 are received in the perforations 2252. The two soldering portions 234 are located on two rears of the two sides of the fastening frame 225. Two cables 40 are soldered to the two soldering portions 234, and pass through the two recesses 2261 and the opening 2231 to stretch out of the second lower holder 22. Then the second upper holder 21 is assembled downward to the second lower holder 22 with a bottom of a periphery of the fastening frame 225 corresponding to tops of the second lateral walls 222, the second rear end wall 223 and the second front end wall 224. The third buckling portions 218 are buckled in the second buckling grooves 227 with the third barbs 2181 hooking top inner ends of the second blocking grooves 228.

Referring to FIG. 1, FIG. 2 and FIG. 3, when the lamp base 20 is assembled upward to the lamp box 10, a bottom of the bottom wall 121 of the first lower holder 12 is located on the first base wall 211 of the second upper holder 21 and a bottom of the second propping wall 125 of the first lower holder 12 is located on the supporting wall 215 of the second upper holder 21. The elastic portions 117 are received in the receiving grooves 216 with the two fastening portions 1172 buckled in the fastening holes 2124 to fasten the lamp box 10 to the lamp base 20 tightly. The pressing portions 1171 project beyond tops of the blocking walls 2123. The insertion piece 131 passes through the insertion slot 1211 to insert into an interval between the two clipping portions 235 to realize an electrical connection between the lamp box 10 and the lamp base 20.

Referring to FIG. 2, FIG. 3, and FIG. 6, when the lamp holder connector 100 is in use, two ends of the U-shaped lamp 30 are received in the receiving spaces 14 of the lamp box 10. Each end of the U-shaped lamp 30 is clamped between the two clamping pieces 133 along the guiding pieces 135. When the U-shaped lamp 30 has a breakdown or a brightness attenuation, press the pressing portions 1171 to push the elastic portions 117 to move inward so as to bring along the fastening portions 1172 to move inward until the fastening portions 1172 are apart away from the fastening holes 2124 completely. In the meanwhile, raise the lamp box 10 upward to apart the lamp box 10 away from the lamp base 20. Then move away the first upper holder 11 from the first lower holder 12 to disassemble the U-shaped lamp 30 from the lamp box 10 swiftly so as to change the U-shaped lamp 30 conveniently.

As described above, the lamp box 10 of the lamp holder connector 100 is fastened to the lamp base 20 of the lamp holder connector 100 tightly by means of receiving the elastic portions 117 in the receiving grooves 216 and buckling the fastening portions 1172 in the fastening holes 2124. The U-shaped lamp 30 is disassembled from the lamp box 10 swiftly by means of pressing the pressing portions 1171 to push the elastic portions 117 to move inward so as to bring along the fastening portions 1172 to move inward until the fastening portions 1172 are apart away from the fastening holes 2124 completely. As a result, the U-shaped lamp 30 can be changed conveniently.

What is claimed is:

1. A lamp holder connector adapted for connecting with a U-shaped lamp, comprising:

a lamp box, including a first upper holder having a top wall, two opposite sides of the top wall bending downward to form two first side walls, a bottom of each first side wall extending downward and then being curved upward to form an elastic portion with a free end thereof facing to an outer surface of the corresponding first side wall, an outer face of each elastic portion defining at least one fastening portion, at least one pair of first lower holders assembled upward to the first upper holder to define receiving spaces between the first upper holder and the first lower holders for receiving two ends of the U-shaped lamp, and at least one pair of first terminals assembled in the receiving spaces respectively with tops thereof contacting with the two ends of the U-shaped lamp and bottoms thereof passing downward through the corresponding first lower holders; and at least one pair of lamp bases assembled upward to the lamp box, each lamp base including a second upper holder having a first base wall, two opposite sides of the first base wall extending upward to form two first lateral walls, a portion of at least one first lateral wall being concaved outward to form a receiving groove, a sidewall of the receiving groove opposite to the other first lateral wall defining at least one fastening hole, the second upper holder being assembled upward to the first lower holder with the elastic portion received in the receiving groove and the fastening portion buckled in the fastening hole, the bottom of the first terminal passing downward through the second upper holder, a second lower holder assembled upward to the second upper holder, and a second terminal received in the second lower holder to electrically connect with the bottom of the first terminal.

2. The lamp holder connector as claimed in claim 1, wherein a top of the free end of the elastic portion defines a pressing portion projecting beyond a top of the sidewall of the receiving groove.

3. The lamp holder connector as claimed in claim 1, wherein the first lower holder includes two second side walls, an outer surface of each second side wall defines at least one first buckling groove, two connecting walls extend downward from two sides of a bottom of the top wall of the first upper holder, at least one first buckling portion protrudes downward from the bottom of the first side wall to be buckled in the first buckling groove, at least one second buckling portion protrudes downward from a bottom of each connecting wall to be buckled in the first buckling groove.

4. The lamp holder connector as claimed in claim 3, wherein a bottom of an inner wall of each first buckling groove is further recessed inward to form a first blocking groove, two bottoms of the first buckling portion and the second buckling portion protrude inward to form a first barb and a second barb hooking top inner end walls of the first blocking grooves respectively.

5. The lamp holder connector as claimed in claim 1, wherein the first upper holder includes a first front wall, two opposite ends of a bottom of the first front wall are recessed upward to form two arc-shaped first grooves, a periphery of each first groove extends forward to form a hemi-tube-shaped first propping wall, the first lower holder includes a second front wall, a top of the second front wall is concaved downward to form an arc-shaped second groove, a periphery of the second groove extends forward to form a hemi-tube-shaped second propping wall matching with the first propping wall.

6. The lamp holder connector as claimed in claim 5, wherein two opposite sides of an outer surface of the first propping wall define two first convex portions with two insertion portions protruding downward from two bottoms of the two first convex portions, two opposite sides of an outer surface of the second propping wall define two second convex portions with two insertion grooves being opened in two tops of the two second convex portions, the insertion portions are inserted in the insertion grooves.

7. The lamp holder connector as claimed in claim 1, wherein at least one third buckling portion protrudes downward from a bottom of each side of the second upper holder, the second lower holder includes two second lateral walls, an outer surface of each second lateral wall defines at least one second buckling groove for buckling the third buckling portion therein.

8. The lamp holder connector as claimed in claim 7, wherein a bottom of an inner wall of each second buckling groove is recessed inward to form a second blocking groove, an inner side of a bottom of each third buckling portion protrudes inward to form a third barb hooking a top inner end of the second blocking groove.

9. The lamp holder connector as claimed in claim 1, wherein each first lateral wall defines a gap, the two opposite sides of the first base wall extend oppositely to form two base extending walls passing through the gaps, two opposite sidewalls of each gap extend outward to form two lateral extending walls, a blocking wall connects with the two lateral extending walls and the base extending wall to surround the receiving groove thereamong.

10. The lamp holder connector as claimed in claim 9, wherein the blocking wall defines the fastening hole for buckling the fastening portion therein.

* * * * *